United States Patent [19]

Moss

[11] Patent Number: 4,829,738

[45] Date of Patent: May 16, 1989

[54] LOOSE-FILL CAVITY INSULATION BY PNEUMATIC INJECTION

[75] Inventor: Robert L. Moss, Lansdale, Pa.

[73] Assignee: CertainTeed Corporation, Valley Forge, Pa.

[21] Appl. No.: 34,286

[22] Filed: Apr. 2, 1987

[51] Int. Cl.[4] ..... E04B 1/00

[52] U.S. Cl. ..... 52/743; 52/404

[58] Field of Search ..... 52/403, 404, 407, 743

[56] References Cited

U.S. PATENT DOCUMENTS

| | | | |
|---|---|---|---|
| 2,788,552 | 4/1957 | Miles . | |
| 2,989,790 | 6/1961 | Brown . | |
| 4,134,242 | 1/1979 | Musz et al. | 52/743 X |
| 4,177,618 | 12/1979 | Felter | 52/404 X |
| 4,342,181 | 8/1982 | Truesdell | 52/743 |
| 4,385,477 | 5/1983 | Walls et al. | 52/404 X |

*Primary Examiner*—David A. Scherbel
*Assistant Examiner*—Creighton Smith
*Attorney, Agent, or Firm*—Paul & Paul

[57] ABSTRACT

A method is provided of installing flowable fibrous insulation in the cavity between the studs of a wall under construction, the wall cavity being open on one side and otherwise enclosed. The method includes covering the open side of the wall cavity with a removable pressure plate to substantially enclose the wall cavity. The pressure plate contains at least one aperture, preferably positioned proximate the top of the pressure plate. The wall cavity is substantially filled with flowable fibrous insulation delivered through the aperture in the pressure plate. The pressure plate is removed, and subsequently the wall cavity is enclosed by addition of the interior wall surface. A blowing wool-grade glass fiber insulation can be used. The method permits construction of well-insulated exterior walls sheathed with a material having an integral vapor barrier and having a wall cavity filled with densely-packed loose-fill insulation. The method permits insulating any partially open cavity.

15 Claims, 1 Drawing Sheet

LOOSE-FILL CAVITY INSULATION BY PNEUMATIC INJECTION

BACKGROUND OF THE INVENTION

1. Field of the Invention

This invention relates to a process for insulating a wall under construction, and more particularly the invention relates to a process for installing loose-fill insulation in a partially enclosed wall cavity.

2. Brief Description of the Prior Art

Loose-fill insulation blown into ceilings and outside wall cavities is very effective in reducing heat transfer in existing buildings. Exterior walls can be reinsulated without removing the interior surface, access to wall cavities being provided by bored holes in exterior siding, or the like. In addition, loose-fill blown insulation can be used in new construction, where insulative batts are often used.

Loose-fill insulation can provide a substantial advantage over batt-type insulation in that the loose-fill material readily assumes the actual shape of the interior cavity being filled, whereas the insulative batts are manufactured in a limited number of standard size widths, none of which will as closely match the actual dimensions of wall cavities encountered in the field. The principle advantage of insulative batts lies in the rapidity with which they can be installed. Installation of loose-fill insulation in walls containing obstructions is as rapid as installation in otherwise empty walls. The loose-fill insulation, properly installed, fills the complete wall cavity, conforming to the actual shape of the wall cavity and providing, in that respect, effective resistance to heat transfer through the wall. Loose-fill insulation also lends itself to installation in ceilings, party walls and essentialy any other place where it is desired to resist heat transfer, as an alternative to batts, especially where there are obstructions such as, water, waste and gas lines, electrical conduits, heating and air conditioning ducts, etc.

In general, when an exterior wall is to be insulated, a vapor barrier is placed between the insulation and the interior surface of the exterior wall, and the exterior surface of the exterior wall is allowed to "breathe" so that adventitious water vapor will not be trapped within the wall. On the other hand, exterior wall sheathing is itself sometimes backed with sheet insulation. For example, aluminum siding is available with polystyrene sheet backing. The sheet insulation provides some measure of protection to the exterior wall on which the sheathing is applied. However, it is also desirable to fill the wall cavity with insulation to further reduce the rate at which heat is transferred through the wall. In this case, a vapor barrier between the insulation in the wall cavity and the interior surface of the wall should not be used, because the insulative sheet in the sheathing itself serves as a vapor barrier. A second barrier would trap moisture within the wall cavity, possibly causing serious damage to the structure.

Prior art methods of insulating new construction with loose-fill insulation preumatically injected or blown into wall cavities require that a retaining sheet, such as a vapor barrier film, screen, etc. be secured on the inside of the wall before insulation is blown into the wall cavity. The retaining sheet prevents loose-fill insulation from falling from the wall cavity before the interior surface of the wall, typically gypsum wall board or the like, is added to enclose the wall cavity. Yet a vapor barrier film should not be used when the exterior surface of the wall itself includes a vapor barrier. Further, the installation of the vapor barrier film is an additional labor-intensive step which increases the cost of construction. Clearly, there is a need for a process for installing loose-fill insulation in new construction without the necessity of fitting a vapor barrier film or the like on the interior surface of the wall before blowing insulation into the wall cavity.

SUMMARY OF THE INVENTION

The present invention provides a method of installing flowable insulation in the volume between the studs of a wall under construction, the volume being open on one side and otherwise enclosed. The method includes covering the open side of the volume with a removable insulation support means to substantially enclose the volume during the blowing-in process. The insulation support means contains at least one aperture, preferably positioned proximate the top of the insulation support means. It is also preferred that the insulation support means include a rigid, transparent plate for viewing the volume as the flowable insulation is installed. Preferably, the insulation support means includes means for temporarily holding the insulation support means in position.

The volume is substantially filled with the flowable insulation delivered through the aperture in the insulation support means. Preferably, the flowable insulation is loose-fill fiberglass insulation which may be compacted to resist flow in the absence of an applied force. After the flowable insulation is delivered to the volume, the insulation support means is removed. The volume is enclosed at such time as is convenient for the builder. If desired, a vapor barrier, such as a polyolefin film, can be secured over the insulation. Alternatively, the interior surface of the wall can be directly applied to enclose the volume. For example, gypsum wall board can be nailed to the studs to enclose the volume.

This process provides a number of significant advantages. For example, no retaining means other than the removable insulation support means need be employed in the process. Thus, the present process can be simpler, less labor-intensive, and less costly to carry out than prior art processes. Further, the present process permits the use of loose-fill insulation for insulating exterior wall cavities even when a vapor barrier has been included with the exterior wall sheathing. This permits architects and contractors to build highly-insulated structures having relatively thin exterior walls. Where the exterior dimensions of the structure size are limited by lot sizes, zoning setback restrictions, and the like, building occupants and owners can thus enjoy greater interior space in well-insulated structures.

The present process also provides significant advantages when a vapor barrier is to be installed on the interior side of the exterior wall. Because the loose-fill insulation is installed in a wall cavity before the vapor barrier is secured to the wall, the vapor barrier need not be disrupted to install the loose-fill insulation in the wall cavity. Disruption of the vapor barrier to install the insulation can necessitate subsequent repair of the vapor barrier. In practice, vapor barrier repair may be neglected or imperfect; in either case the integrity of the vapor barrier can be lost. Conversely, in the present process an integral vapor barrier film can be easily installed at a convenient time after the insulation has been installed in the wall cavity.

Other objects and advantages of the present invention will become readily apparent to those skilled in the art from a reading of the following brief description of the drawings, the detailed description of the preferred embodiment, and the appended claims.

DETAILED DESCRIPTION OF THE PREFERRED EMBODIMENT

Figure 1:
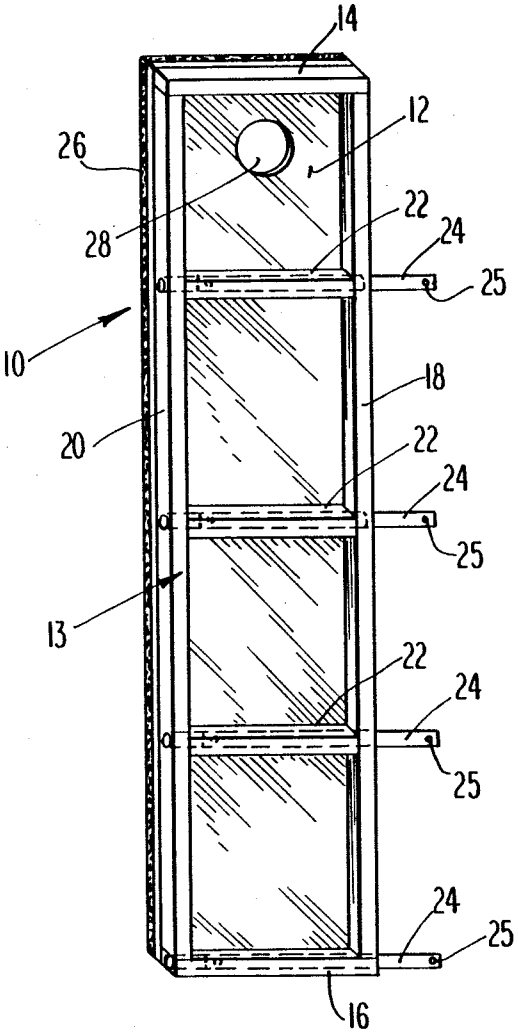
FIG. 1 is a perspective view of an insulation support means for use in the process of the present invention.

Referring now to the drawings in detail, wherein like reference numerals indicate like elements in each of the several views, reference is first made to FIG. 1, wherein an insulation support means or plate 10 for use in the process of the present invention is illustrated. The plate 10 includes a frame 13 to which is secured a rigid, transparent planar support member or sheet 12.

The frame 13 is formed from top and bottom frame members 14, 16, a pair of side frame members 18, 20, and a plurality of preferably hollow cross frame members 22. The frame 13 is formed from a light-weight, rigid structural material, such as wood, aluminum or the like. The plate is selected to be of the approximate size of the opening, and thus the dimensions of the frame 13 are chosen to reflect the dimensions of the wall cavity which is to be filled with flowable insulation. For example, when 2-inch by 6-inch studs are spaced 24 inches on center, the top and bottom frame members 14, 16 and the cross frame members 22 are chosen to be approximately 24 inches in length. Similarly, the side frame members 18, 20 are selected to approximate the height of the studs.

A plurality of attachment means 24, preferably of the quick-release slide bar or extension arm type, are slideably carried within each side of (or alternate ones of) a plurality of cross frame members 22, as desired, and optionally within top and bottom frame members 14 and 16, on the exterior sides of the frame 13, the attachment means 24 are telescopically received within the cross frame members and are adapted to be slid outwardly therefrom enough for fasteners such as self tapping screws to be applied through screw holes 25 in attachment bars 24, to engage the sides of the studs defining the wall cavity. The attachments 24 permit the plate 10 to be quickly and easily affixed to and removed from the studs. Variations in the spacing of the studs can be accommodated by the adjustable positioning allowed by the sliding bars 24.

Optionally, a gasket 26 is affixed to the planar member 12 at locations of the top and bottom frame members 14, 16 and the side frame members 18, 20. The gasket 26, which can be formed from a porous, compressible polymeric material, such as polyurethane, bridges gaps which might otherwise exist between the plate 10 and the wall members forming the cavity to be insulated. The loss of insulation through such gaps occurring while the insulation is being installed is thus reduced.

The planar support member 12 is preferably formed from a rigid, transparent or translucent material, such as polymethylmethacrylate, polycarbonate, or the like. The planar member 12 is preferably secured to the frame 13 by attachment means such as screws so that substantially no gaps exist between the frame 13 and the planar member 12 which would permit the leakage of insulation during installaton of the insulation. The transparent planar member 12 permits the operator to visually observe and if necessary, to control the filling of the wall cavity with insulation. The planar member 12 includes at least one aperture 28 formed in it proximate the top of the member 12. The aperture 28 is shaped and sized to permit a conduit for carrying insulation to pass therethrough.

Figure 2:
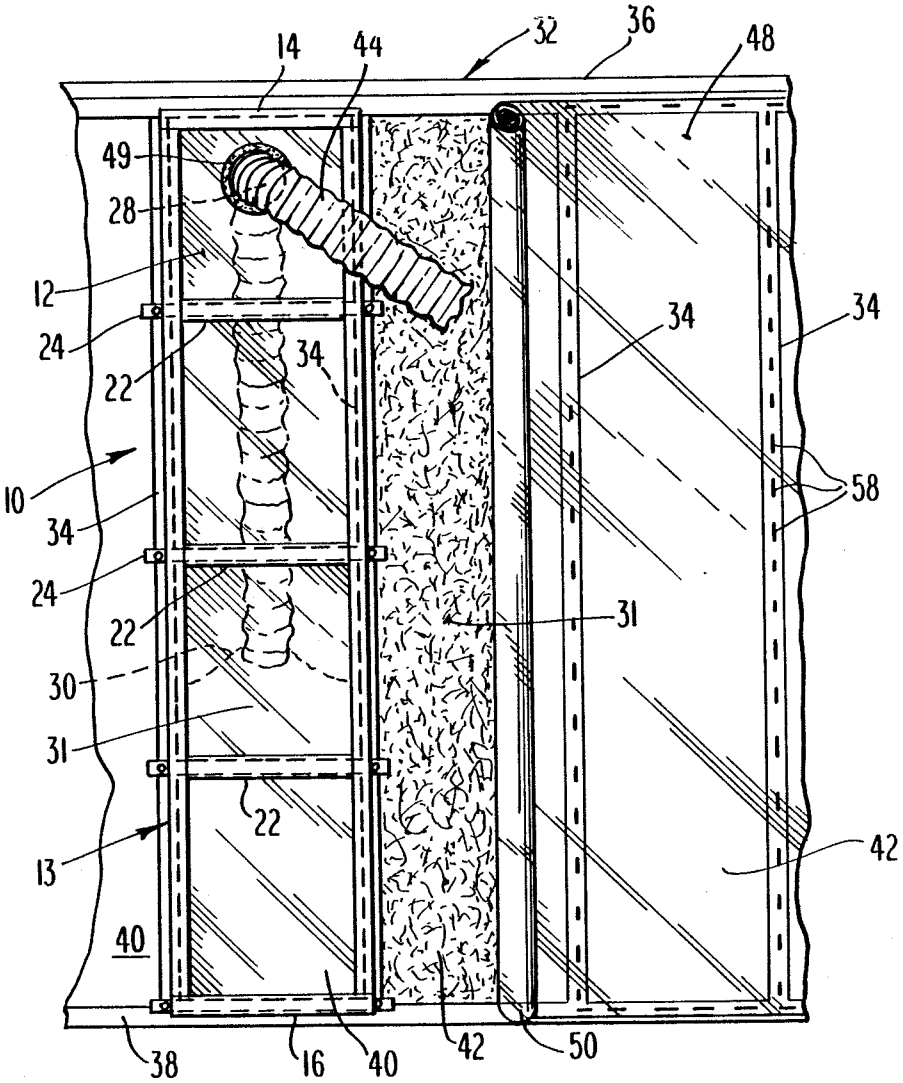
FIG. 2 is a front elevational view showing an exterior wall under construction and being insulated by the process of the present invention.

The use of the plate 10 in the process of the present invention is shown in FIG. 2. The plate 10 is positioned over a partially-enclosed wall cavity or volume 40 to be filled with insulation, and the bars 24 are adjusted and fastened to studs to temporarily but firmly secure the plate 10 to the studs 34 forming the sides of the wall cavity 40. The wall cavity 40 is enclosed on the bottom by a sole plate 38 and on top by top plates 36. The back of the wall cavity 40 is defined by the exterior surface of the wall 32. The exterior surface of the wall 32 may be sheathing, siding, shingling, plywood paneling, stucco, or the like (not shown). When the pressure plate 10 is applied, the wall cavity 40 becomes substantially enclosed. The partially enclosed wall cavity 40 may be formed by a new, partially constructed exterior wall, or the partial enclosure of the wall cavity 40 may occur when the interior surface of an existing exterior wall is removed.

A flexible hose or duct 44 is inserted through the aperture 28 in the sheet 12 by an operator, often referred to as a "hoseman" in the trade. The duct 44, is positioned within the wall cavity 40 to deliver insulation to yield a highly uniform, densely-packed layer 31 of flowable insulation 30. Preferably, the open end of the duct 44 is initially inserted well down into the wall cavity 40 and spaced a predetermined distance from the sole plate 38.

A shield 49 surrounds the duct 44 to cover the aperture to prevent excess fiber from being expelled from the cavity. The shield 49 is preferably constructed of rubber, urethane or other elastomeric material. Alternatively, the shield could be of metal or plywood construction.

On signal from or under the control of the hoseman, delivery of flowable insulation 30 is begun. The flowable insulation is pumped from a reservoir using a conventional insulation blowing machine (not shown) and conveyed through the duct 44 to be pneumatically injected into the wall cavity 40. As the flowable insulation 30 is delivered to the wall cavity 40, the hoseman, upon feeling the flow of insulation cease as the cavity fills up to the discharge end of the hose or duct 44, slowly draws the duct 44 upward in the wall cavity 40, and the cavity fills to another level. This practice continues until the cavity is filled. Preferably, when glass fiber insulation is used, the flowable insulation 30 is delivered to the wall cavity 40 to provide a packed insulation density of from about 2.0 to 2.5 $lb/ft^3$.

When the wall cavity 40 has been substantially filled, the operator stops the delivery of flowable insulation 30 through the duct 44. Preferably, the aperture 28 in the support member 12 is sized to permit the duct 44 to easily pass therethrough, while also permitting any air pressure built up within the wall cavity 40 caused by the displacement of air within the cavity 40 by flowable insulation 30 to be relieved.

The duct 44 is then withdrawn through the aperture 28. The bars 24 are unscrewed from the studs and the pressure plate 10 is removed leaving a filled wall cavity 42 containing a layer 31 of insulation. The plate 10 can be subsequently mounted to enclose the next adjacent wall cavity 42, as shown in FIG. 2. If and when desired, the inerior wall surface can be installed directly over the layer of installed insulation 31. For example, gypsum wall board (not shown) can be nailed, screwed, or otherwise secured to the studs 34. On the other hand, if desired, a vapor barrier can be installed to seal the insulation prior to applying the interior surface to the wall. As shown in FIG. 2, a polyolefin film, such as polyethylene film, delivered, for example, from a roll 50 can be used to cover the interior surface of the insulation-filled wall cavity 42 forming a vapor barrier sheet 48. The vapor barrier sheet 48 can be secured to the studs by staples 58 or any other conventional means.

As noted above, the flowable insulation 30 employed in the present process is preferably designed so that the insulation 30, once it has filled a cavity, is free-standing in the absence of a front enclosure and will not fall out in the absence of an applied force. Thus, the insulation 30 will not fall out of the wall cavity 40 when the plate 10 is removed after the wall cavity 40 has been filled with the flowable insulation 30. This capability is imparted to the material by the method of application. Most currently available insulating materials can be employed in the present process. However, the product must be fibrous and capable of expansion. For example, fibrous loose-fill insulating materials, such as cellulosic and mineral fibers can be used. Glass fiber loose-fill insulation is preferred; and blowing wool-grade glass fiber insulation without a binder is especially preferred because of the ability of the fibers to hold the blown-in insulation blanket in place after the plate is removed. Generally there is a fiber conditioning prior to blowing, by an expansion of the fibers, created in the blowing machine (known in the trade), to achieve fiber separation, and a lubricant on the fibers prevents their breaking during the conditioning process. A blowing wool-grade glass fiber insulation without binder such as Insul Safe III (trademark of CertainTeed) can be used. Other types of fiberous loose-fill insulation may also be used in the present invention. Any type of loose-fill fibrous insulation which can be compression molded in the absence of a binder can be used.

In general, the insulation support means is adapted to conform to the shape of the wall cavity, so as to substantially enclose the wall cavity. For example, the wall cavities illustrated in FIG. 2 having an open side which is generally planar and the support member 12 of the insulation support means 10 is also generally planar. However, other wall geometries, such as corners, curved walls, and the like, can be easily accommodated by using conforming support members (not shown).

If desired, the insulation support means 10 can be constructed to enclose a greater volume than that defined by a pair of adjacent studs 34 as shown in FIG. 2. For example, the present process can be used in the factory installation of loose-fill insulation in mobile homes, truck bodies, and the like. In this case, the insulation support means can be constructed to enclose entire walls or sections thereof, or even the entire interior surface of the exterior wall of an individual unit under construction, such as a mobile home. The insulation support means need be installed only once prior to pneumatically installing flowable insulation in each of the wall cavities (not illustrated), thus providing a substantial savings and cost in time.

Numerous modifications and variatons in the present process will be understood to be within the purview of the present invention as defined in the appended claims by those skilled in the art. For example, those skilled in the art will understand that the present process can be used to fill partially-enclosed cavities in roofs, knee walls, and other locations in new construction and existing structures.

What is claimed is:

1. A method of installing flowable insulation in a wall under construction, the wall having at least one volume defined on two sides by a pair of generally parallel studs, on the top by a top plate, on the bottom by a sole plate, and on the back by a generally planer surface, the front side of the volume being open, the method comprising:

(a) first covering the open side of the volume with a removable substantially rigid, insulation support means to substantially enclose the volume, the insulation support means containing at least one aperture;

(b) then substantially filling the volume with flowable insulation materials with sufficient fiber length to be free-standing after filling and removal of the support means, with such insulation being delivered through the at least one aperture in the insulation support means;

(c) then removing the insulation support means, leaving the insulation in the volume freestanding and unsupported across the open front side; and (d) subsequently enclosing the volume across the open front side.

2. A method according to claim 1 wherein the flowable insulation materials comprise fibrous material.

3. A method according to claim 1 wherein the flowable insulation materials are glass fiber insulation.

4. A method according to claim 3 wherein the glass fiber insulation is delivered to substantially fill the volume at a density of from about 2.0 to 2.5 $lb/ft^3$.

5. A method according to claim 4 wherein the glass fiber insulation is a blowing wool-grade glass fiber insulation.

6. A method according to claim 1 additionally comprising covering the volume with a vapor barrier after the insulation support means is removed.

7. A method according to claim 6 wherein the vapor barrier comprises polyolefin sheet.

8. A method according to claim 1 wherein the insulation support means comprises a rigid, transparent member for viewing the flowable insulation as the flowable insulation is supplied to the volume through the at least one aperture.

9. A method according to claim 1 wherein the insulation support means comprises means for temporarily holding the insulation support means in position as the flowable insulaton is delivered to the volume.

10. A method according to claim 1 wherein the one side of the volume which is open is generally planar, and the insulation support means comprises a generally planar member.

11. A method according to claim 10 wherein the insulation support means additionally comprises sealing means for temporarily sealing the open side of the volume using the insulation support means.

12. A method according to claim 1 wherein the flowable insulation materials are pumped from a remote supply through a flexible conduit, the flexible conduit extending through the at least one aperture in the insulation support means.

13. A method according to claim 12 wherein the flexible conduit has an open end, the open end being positioned within the volume, the height of the open end being varied by an operator as the flowable insulation materials are delivered to the volume.

14. A method according to claim 1 wherein the at least one aperture is positioned proximate the top of the insulation support means.

15. A method of insulating an exterior wall of a structure under construction, the exterior wall having an interior volume having one open side and being otherwise enclosed, the method comprising:

(a) first covering the open side of the volume with a removable, substantially rigid insulation support means to substantially enclose the volume on all sides thereof;

(b) then substantially filling the volume with flowable insulation materials with sufficient fiber length to be free-standing after filling and removal of the support means;

(c) then removing the insulation support means, leaving the insulation in the volume free-standing and unsupported across the open front side; and (d) subsequently enclosing the volume across its open side.

* * * * *